US005390654A

United States Patent [19]

Perkins

[11] Patent Number: 5,390,654

[45] Date of Patent: Feb. 21, 1995

[54] BOW STRING STABILIZER BAR

[75] Inventor: Eugene W. Perkins, Dawsonville, Ga.

[73] Assignee: Perkins Stabilizer, Inc., Cumming, Ga.

[21] Appl. No.: 1,679

[22] Filed: Jan. 7, 1993

[51] Int. Cl.[6] ..... F41B 5/00

[52] U.S. Cl. ..... 124/24.1; 124/35.2; 124/88

[58] Field of Search ..... 124/88, 89, 86, 23.1, 124/24.1, 25.6, 41.1, 35.2, 35.1, 31, 25, 80, 90–92, 1

[56] References Cited

U.S. PATENT DOCUMENTS

| | | | |
|---|---|---|---|
| 2,815,016 | 12/1957 | Kellogg | 124/35.2 |
| 2,982,279 | 5/1961 | Pursley | 124/35.1 |
| 3,561,418 | 2/1971 | Fredrickson | 124/24.1 |
| 3,794,012 | 2/1974 | Ramsey | 124/24.1 |
| 3,895,621 | 7/1975 | Kellogg | 124/24.1 |
| 4,329,972 | 5/1982 | Wilson | 124/24.1 |
| 4,603,676 | 8/1986 | Luoma | 124/35.1 X |
| 4,919,107 | 4/1990 | Bunts | 124/88 X |
| 5,092,308 | 3/1992 | Sheffield | 124/35.2 X |
| 5,156,138 | 10/1992 | Grover | 124/24.1 X |

*Primary Examiner*—Randolph A. Reese
*Assistant Examiner*—Harry C. Kim
*Attorney, Agent, or Firm*—Oblon, Spivak, McClelland, Maier & Neustadt

[57] ABSTRACT

A bow string stabilizer bar is telescopically carried by a bracket attached to a bow. The bar carries at its end remote from the bow a bow string clamp and handle assembly and a flexible element, whose length is adjustable, limits the extent to suit an individual archer to which the bar can be telescopically extended and hence the extent to which the bow string can be retracted preparatory to shooting an arrow. The stabilizer bar restrains the bow and bow string to move in a relatively fixed plane each time the string is retracted for shooting an arrow, thereby vastly increasing the accuracy of the archer.

6 Claims, 3 Drawing Sheets

BOW STRING STABILIZER BAR

FIELD OF THE INVENTION

This invention relates to archery and more particularly to apparatus for stabilizing a drawn bow string against inadvertent lateral deflection by the archer's hand.

BACKGROUND OF THE INVENTION

When an archer draws a bow string with a notched arrow he tries to anchor the string drawing hand on a part of his head, say, his cheek or chin, but there is tendency for the hand holding the bow to wobble slightly relative to the anchored hand so that the arrow upon release of the bow string is projected along a path which is to one side or the other of the intended flight path to the target.

A principal object of the invention is to provide a stabilizer bar which extends from the bow to the limit of a drawn bow string and has sufficient rigidity to prevent the bow or notched arrow end from moving relative to each other as the arrow is aimed at a target.

Another object of the invention is to provide adjustable means for limiting the maximum drawn extent of the bow string to suit an individual archer.

Still another object of the invention is to provide a stabilizer bar which is extensible and retractable in length between a bow string in its unflexed condition and the string in its fully flexed condition thus minimizing structure extending beyond the bow which could impede an archer's travel through undergrowth or over rough terrain.

The foregoing and other objects will become apparent as the following detailed description is read in conjunction with the accompanying drawings wherein:

DETAILED DESCRIPTION OF THE INVENTION

Figure 1:
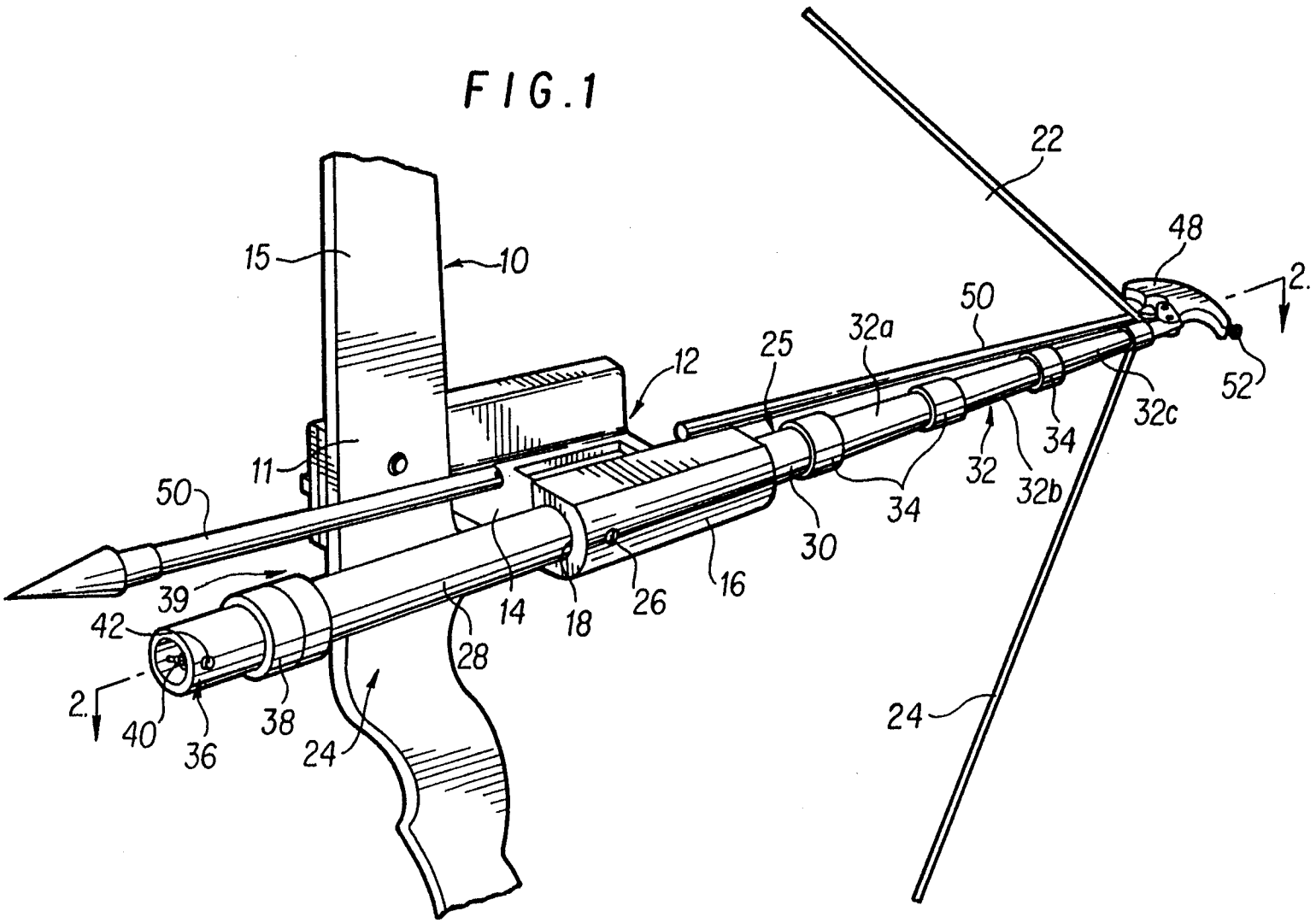
FIG. 1 is a perspective view of a bow and drawn bow string showing a stabilizer bar of the present invention.

Referring now to the drawings and particularly FIG. 1, the numeral 10 designates a bow to whose mid point 11 is attached a bracket 12 which includes a platform 14 normal to the vertical axis 15 of the bow when in its position of FIG. 1. The platform 14 carries a housing member 16 having an open ended bore 18 therethrough whose longitudinal axis 20 (FIG. 3) is perpendicular to the vertical axis 15 of the bow 10, when in the position of FIG. 1, and laterally spaced from but parallel to the plane 22 defined by a drawn bow string 24 as should be clear in FIG. 3.

A tube 25 is fixed, as by a set screw 26, within the through bore 18 and has front and rear parts 28, 30. An extensible and retractable stabilizer bar, generally indicated by the numeral 32, is telescopically connected to the rear part 30 of the tube 25. The bar 32 comprises as many sections 32*a*, 32*b*, 32*c*, as convenient, with each section having a limiting collar 34 as is conventional with telescoping tubular members.

A linearly adjustable member 36 is carried by the front part 28 of the fixed tube 25. The member 36 desirably comprises a tube which is telescopically received within the outer open end of the front part 28 of the fixed tube 25 and is provided with a locking collar 38 which cooperates with a collar 39 on the front end 28 of the fixed tube 25. The locking collar 38 is of conventional construction and may be of the type which, when turned in one direction releases camming surfaces (not shown) from radially movable internal clamp members (not shown) to permit the adjusting tube 36 to be moved linearly in or out of the front tube part 28 and, when correctly positioned as further explained below, to be locked in its adjusted position by turning the collar in the opposite direction.

Figure 2:
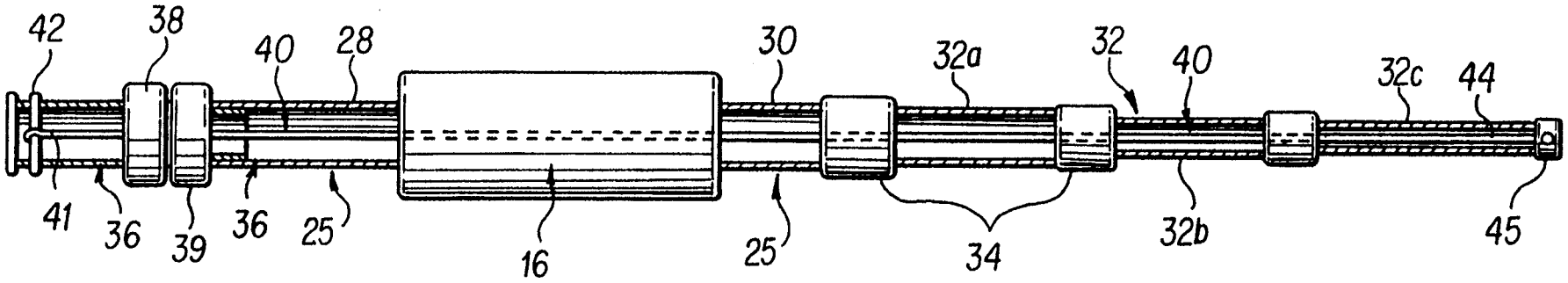
FIG. 2 is a horizontal cross sectional view of the stabilizer bar of the invention, with parts omitted for clarity, taken substantially on the line 2—2 of FIG. 1.

In accordance with the invention a flexible element 40 is connected at one end 41, as by a cross pin 42 best seen in FIG. 2, to the adjustable tubular element 36 and at its opposite end 44 to that end 45 of the stabilizer bar 32 which is remote from the bow 10.

Figure 3:
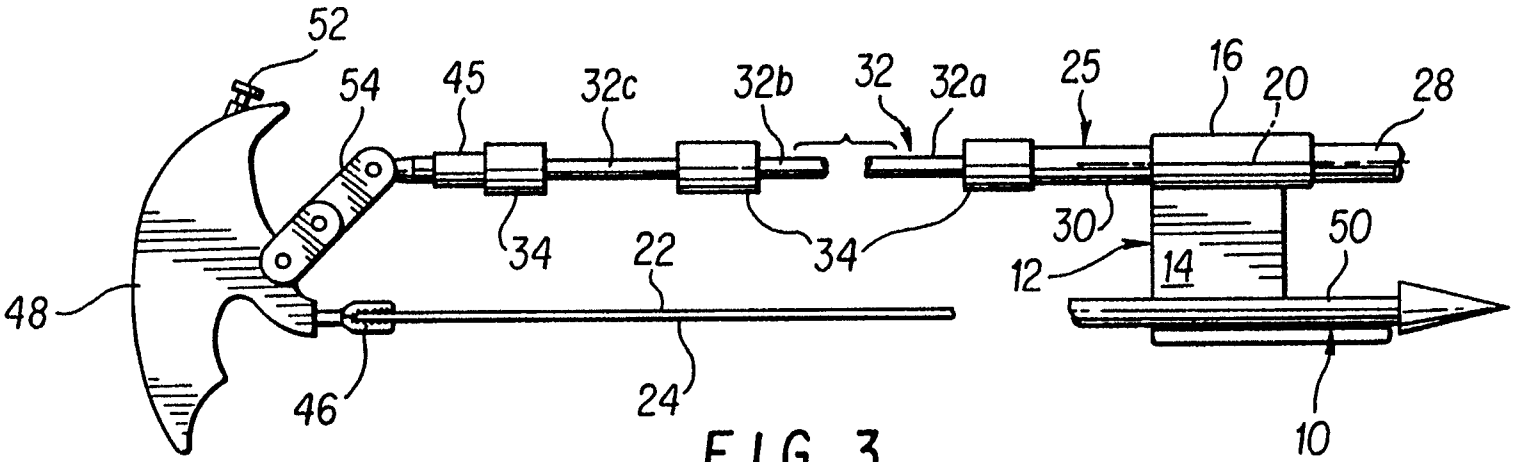
FIG. 3 is a top plan view partly broken away showing the manner of use of the present invention.
Figure 4:
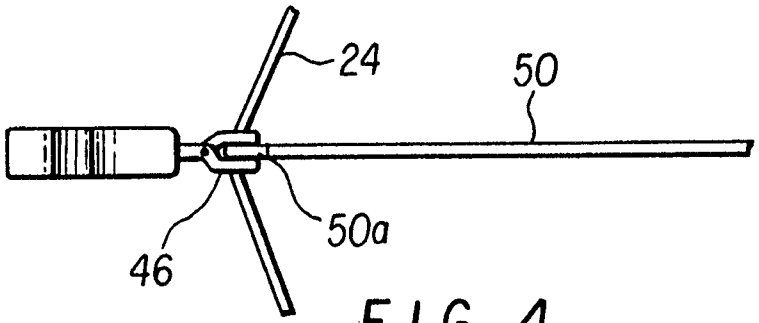
FIG. 4 is a side elevational view partly broken away showing an arrow notched in a drawn bow string.

A releasable bow string clamp 46, including a handle 48 graspable by an archer to retract the bow string 24 and flex the bow in readiness for shooting an arrow 50, is connected to the remote end 45 of the stabilizer bar 32 as best seen in FIG. 3. The handle 48 and clamp 46 are entirely conventional and in current use by archers to relieve the stress on fingers normally used to retract a bow string. Such clamps and handles are provided with a depressible button 52 or similar release device readily accessible to the archer's thumb, or to a finger, should the device 52 be a trigger, which, when depressed, causes the jaws of the clamp 46 to open and release the bow string 24 which in turn projects the arrow 50. As seen in FIG. 3 the handle and clamp assembly 46, 48 is connected to the remote end 32 of the stabilizer bar by a suitable linkage 54 which resists movement in any direction of the drawn bow string relative to the stabilizer bar 32.

In use, the archer initially fastens the bracket 12 to the mid point 11 of the bow 10, with the platform 14 serving to support an arrow 50 in shooting position between a side of the bow and the confronting side face of the housing member 16 as shown in FIG. 1. He then releases the locking collar 38 for the adjustable tube 36 and connects the bow string to the clamp 46, but without an arrow notched to the string. He draws the bow string to the maximum extent which is comfortable for him and, while holding the bow string in this position, an assistant may be requested to pull the adjustable tube 36 forwardly until the flexible element 42 is taut whereupon the assistant rotates the collar 38 to lock the adjustable tube 36 in its adjusted position. Thereafter, the flexible element will limit the maximum pull on the bow string to the same extent which is suitable for that particular archer.

Figure 5:
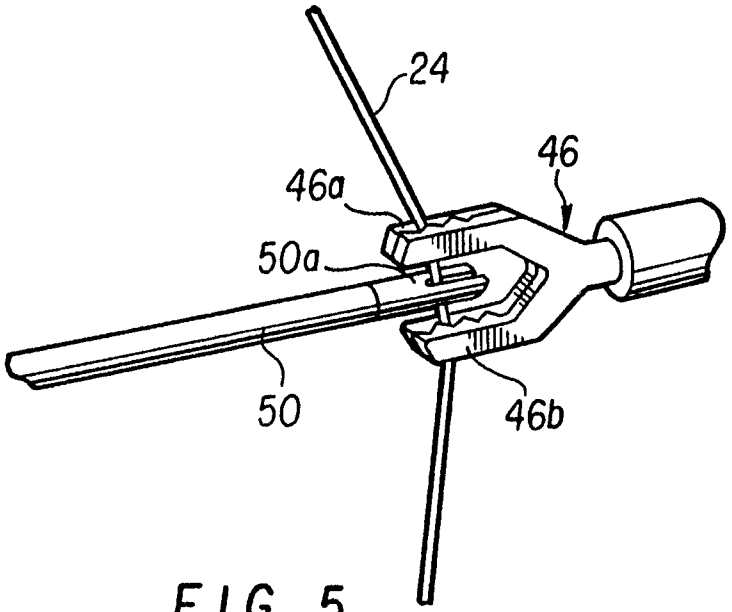
FIG. 5 is an enlarged broken perspective view of a typical bow string clamp which may be used in conjunction with the present invention.

It will be apparent, particularly in FIG. 5, that when the jaws of the clamp 46 engage the bow string 24 the inner end 50*a* of the arrow 50 is notched to the string 24 between upper and lower jaw parts 46*a* and 46*b* as is conventional. Further, it will be noted in FIG. 3 that the clamp 46 is off-set from the axis of the stabilizer bar so as to be in alignment with the arrow supporting portion of the platform 14. After the archer has aimed at the target with the arrow 50 being stabilized along its entire length relative to the bow through the steadying action of the stabilizer bar, and the string has been released by the jaws in response to depression of the button 52, the archer telescopically retracts the stabilizer bar by pushing the sections together until the bar is almost entirely within the fixed tube 28 except for the collars 34, and the jaw/handle assembly 46, 48. Thus when the archer is traveling over terrain covered with thick vegetation, the stabilizing tube presents only slight structure which can be hung up on the vegetation to impede the archer's progress. Normally, the bow string would be reengaged with the clamp following each shot of an arrow. Also, when hunting, an arrow would likely be notched onto the string while it and the bow are unstressed. Should game suddenly appear, the archer would pull back on the handle 48 to extend the telescoping stabilizer bar 32 until the flexible element 42 is taut, aim the arrow at the game, and depress the release button to project the arrow with reasonable assurance that it would strike the target since the string, bow and arrow are essentially bound together by the stabilizer bar against relative lateral movement between these parts which otherwise could cause the arrow to be projected in a path leading to one side or the other of the target.

Figure 6:
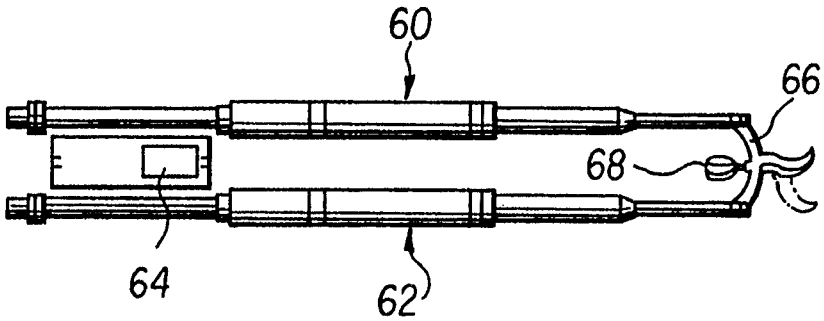
FIG. 6 is a schematic top plan view of dual stabilizing bars constructed in accordance with the invention.

With reference to FIG. 6 there is schematically shown there dual stabilizer bars 60, 62 each of which is identical to the single stabilizer bar 32 described above. In FIG. 6, a bow (not shown) would be received in a central opening 64 of the bracket platform with any means, such as vertical flanges (not shown) being provided for fastening the assembly to the sides of a bow. The remote ends of the bars are interconnected by a handle 66 carrying a clamp 68 which is off-set to one side so as to align with the platform part on that side of the bow on which an arrow is supported while being shot. Only a single flexible member to limit the extent of bar extensions need be supplied though the use of two flexible members, one for each bar, is not precluded.

It should be apparent that the invention is susceptible of changes and modifications without, however, departing from the scope and spirit of the appended claims.

What is claimed is:

1. A stabilizer for stabilizing a drawn bow string comprising a bracket fixed to a mid-portion of a bow; a first housing member on said bracket having an open ended bore therethrough having front and rear parts and whose longitudinal axis is perpendicular to the mid-portion of said bow and laterally spaced from but parallel to a plane defined by said drawn bow string; a tube fixed within said through bore and having front and rear parts, a first extensible and retractable stabilizer bar comprising a plurality of telescoping sections including a forward section telescopically received in said rear part of said tube, adjustable means for adjusting a maximum extent to which said stabilizer bar can be telescopically extended relative to said bow, a releasable bow string clamp carried on an end of said stabilizer bar remote from said bow and including a handle graspable by an archer to retract said bow string and flex said bow in readiness for shooting an arrow while also telescopically increasing the length of said stabilizer bar to said adjusted maximum extent, and means operable by the hand of said archer for selectively releasing said bow string clamp after said bow string has been drawn to said adjusted maximum extent.

2. The stabilizer of claim 1 wherein said bracket includes a platform for supporting said arrow in shooting position between an outer side of said bow and a confronting side face of said housing member, said bow string clamp being off-set from the axis of said stabilizer bar so as to be in alignment with said platform.

3. The stabilizer of claim 1 wherein said adjustable means comprises a linearly adjustable element carried by the front part of said fixed tube, a flexible element connected at one end to said adjustable element and at its opposite end to said remote end of said stabilizer bar, said adjusted maximum extent of telescopic extension of said bar and hence said bow string retraction being determined by an adjusted length of said flexible element.

4. The stabilizer of claim 3 including a second stabilizer bar identical to said first stabilizer bar, said handle connecting remote ends of both said stabilizer bars, said bracket being of a size to extend laterally to either side of said bow and carrying a second housing member positioned identically to said first housing member, said flexible element limiting the extent of said bar extension and said bow string retraction.

5. The stabilizer bar of claim 1 wherein said stabilizer bar when said sections are telescopically pushed together is of a size to be received substantially entirely within said fixed tube with substantially no part of said bar extending forwardly of said bow.

6. A stabilizer for stabilizing a drawn bow string comprising a bracket fixed to a mid-portion of a bow, a housing member on said bracket having a bore therein with an open rear end and a longitudinal axis which is perpendicular to said mid-portion of said bow and laterally spaced from but parallel to a plane defined by said drawn bow string; a tube fixed within said bore, an extensible and retractable stabilizer bar telescopically received in a rear end of said tube, adjustable means for adjusting the extent to which said stabilizer bar can be telescopically extended relative to said bow, said adjustable means including means for enabling the adjusted extent of bar extension to be changed to suit the desired bow string draw of different archers, a releasable bow string clamp carried on an end of said stabilizer bar remote from said bow and including a handle graspable by an archer to retract said bow string and flex said bow in readiness for shooting an arrow while also telescopically increasing the length of said stabilizer bar to its adjusted extent, and means operable by the hand of said archer for selectively releasing said bow string clamp after said bow string has been drawn to the extent permitted by the adjusted extent to which said stabilizer bar may be extended, said adjustable means comprising a flexible element having a first end attached to that end of said stabilizer bar remote from said bow, a second end attached to said tube and means for adjusting the length of said flexible element to conform to an individual archer's desired length of bow string draw.

* * * * *